US011460242B1

(12) United States Patent
Swamulapalli et al.

(10) Patent No.: US 11,460,242 B1
(45) Date of Patent: Oct. 4, 2022

(54) UNDER-SHELF STORAGE BIN FOR A REFRIGERATOR APPLIANCE

(71) Applicant: Haier US Appliance Solutions, Inc., Wilmington, DE (US)

(72) Inventors: Mahesh Swamulapalli, Hyderabad (IN); Shashidhar Taraka, Hyderabad (IN); Sandeep Shankar, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/389,686

(22) Filed: Jul. 30, 2021

(51) Int. Cl.
*F25D 25/02* (2006.01)
*A47B 88/60* (2017.01)

(52) U.S. Cl.
CPC ..... *F25D 25/027* (2013.01); *A47B 88/60* (2017.01); *F25D 25/022* (2013.01); *F25D 2325/021* (2013.01)

(58) Field of Classification Search
CPC ..... F25D 25/00; F25D 25/005; F25D 25/02; F25D 25/021; F25D 25/022; F25D 25/027; F25D 23/04; F25D 2325/021; A47B 46/005; A47B 88/60
See application file for complete search history.

(56) References Cited

U.S. PATENT DOCUMENTS

| | | | | |
|---|---|---|---|---|
| 2,242,903 | A * | 5/1941 | Crimmel | F25D 25/021 108/26 |
| 2,755,158 | A * | 7/1956 | Davidson | F25D 25/021 312/404 |
| 3,519,319 | A * | 7/1970 | Taylor | A47B 88/48 312/246 |
| 4,775,201 | A | 10/1988 | Thomson | |
| 7,950,756 | B2 * | 5/2011 | Collins | F25D 25/02 312/408 |
| 8,408,666 | B2 * | 4/2013 | Armstrong | A47B 88/407 312/408 |
| 9,285,160 | B1 * | 3/2016 | Kang | A47B 88/48 |
| 9,775,458 | B2 * | 10/2017 | Rivera | A47B 46/005 |
| 2016/0088933 | A1 * | 3/2016 | Rossignol | A47B 88/60 312/270.2 |
| 2017/0151913 | A1 * | 6/2017 | Granzotto | A47B 88/402 |

FOREIGN PATENT DOCUMENTS

| | | | | |
|---|---|---|---|---|
| CN | 104089457 B | 9/2017 | | |
| EP | 1278035 A2 * | 1/2003 | | F25D 25/02 |
| WO | WO-2018029879 A1 * | 2/2018 | | F25D 25/00 |

* cited by examiner

*Primary Examiner* — Andrew M Roersma
(74) *Attorney, Agent, or Firm* — Dority & Manning, P.A.

(57) ABSTRACT

A refrigerator appliance includes a chilled chamber and a shelf positioned within the chilled chamber. The shelf is supported by lateral mounting bracket that define support features for an under-shelf storage bin. The support features include mounting pins and/or guide ribs that are configured to engage complementary rollers or hooking protrusions defined on the lateral sides of the storage bin. The support features permit a user to pull the storage bin away from the shelf along a transverse direction and/or pivot the shelf downward along the vertical direction.

12 Claims, 9 Drawing Sheets

UNDER-SHELF STORAGE BIN FOR A REFRIGERATOR APPLIANCE

FIELD OF THE INVENTION

The present subject matter relates generally to refrigerator appliances, and more particularly to storage bins for refrigerator appliances.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Notably, conventional refrigerator appliances include a plurality of floating shelves that are mounted to a back wall of the fresh food chamber. The height of these shelves is commonly adjustable, e.g., via a track mounting system, but there is frequently wasted space between shelves and items stored below. In addition, shelves are often not ideal for storage of smaller refrigerated items, e.g., such as items that might get lost on a shelf, that have a tendency to roll, etc.

Accordingly, a refrigerator appliance with features for improving storage of various food items would be useful. More particularly, a storage system for a refrigerator appliance that minimizes wasted space and facilitates storage of smaller items would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a refrigerator appliance defining a vertical direction, a lateral direction, and a transverse direction is provided. The refrigerator appliance includes a cabinet defining a chilled chamber, a door being rotatably hinged to the cabinet to provide selective access to the chilled chamber, a shelf positioned within the chilled chamber, the shelf defining a locking flange at a front portion of the shelf, a mounting bracket supporting the shelf within the chilled chamber, the mounting bracket defining a mounting pin and a lower guide rib, and a bin assembly. The bin assembly includes a storage bin positioned below the shelf and being movable between an open position and a closed position, an upper hooking protrusion extending from the storage bin toward the mounting bracket, the upper hooking protrusion being supported by the mounting pin and being rotatable relative to the mounting pin as the storage bin is moved between the open position and the closed position, a bin roller mounted to the storage bin and slidably engaging the lower guide rib as the storage bin is moved toward the open position, the bin roller being seated in a concave bottom of the lower guide rib to support the storage bin in the open position, and a latch assembly comprising a latch member that selectively engages the locking flange of the shelf to support a front portion of the storage bin in the closed position.

In another exemplary embodiment, a refrigerator appliance defining a vertical direction, a lateral direction, and a transverse direction is provided. The refrigerator appliance includes a cabinet defining a chilled chamber, a door being rotatably hinged to the cabinet to provide selective access to the chilled chamber, a shelf positioned within the chilled chamber, a mounting bracket supporting the shelf within the chilled chamber, the mounting bracket defining a front guide rib and a rear guide rib, and a bin assembly. The bin assembly comprises a storage bin positioned below the shelf and being movable between an open position and a closed position, a rear roller mounted to the storage bin and being slidably seated within the rear guide rib for supporting a rear portion of the storage bin as the storage bin moves between the open position and the closed position, and a front roller mounted to the storage bin and being slidably seated against the front guide rib for supporting a front portion of the storage bin as the storage bin moves between the open position and the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
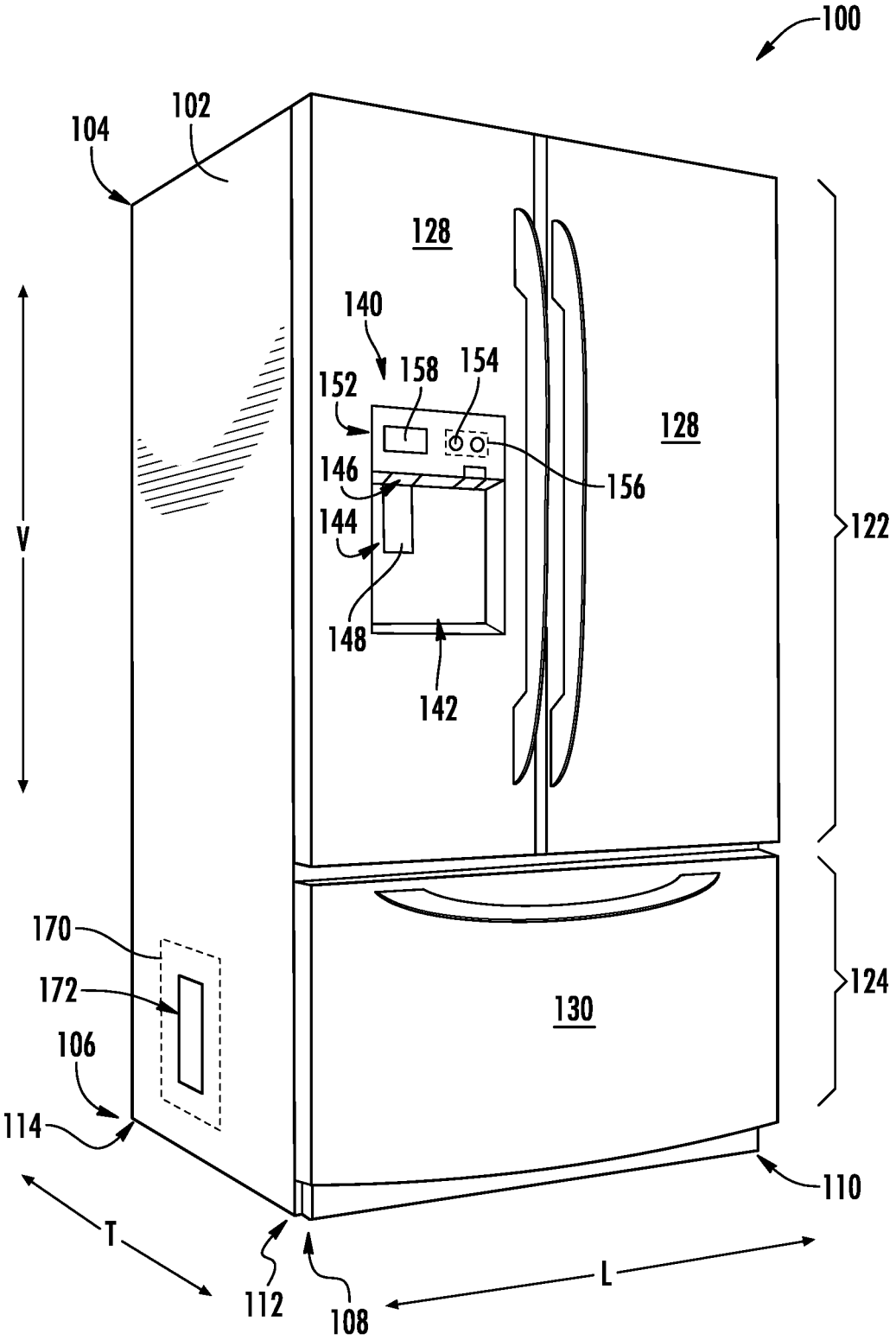
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

FIG. 1 provides a perspective view of a refrigerator appliance 100 according to an exemplary embodiment of the present subject matter. Refrigerator appliance 100 includes a housing or cabinet 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

Cabinet 102 defines chilled chambers for receipt of food items for storage. In particular, cabinet 102 defines fresh food chamber 122 positioned at or adjacent top 104 of cabinet 102 and a freezer chamber 124 arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Moreover, aspects of the present subject matter may be applied to other appliances as well, such as other appliances including fluid dispensers. Consequently, the description set forth herein is for illustrative purposes only and is not intended to be limiting in any aspect to any particular appliance or configuration.

Refrigerator doors 128 are rotatably hinged to an edge of cabinet 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. To prevent leakage of cool air, refrigerator doors 128, freezer door 130, and/or cabinet 102 may define one or more sealing mechanisms (e.g., rubber gaskets, not shown) at the interface where the doors 128, 130 meet cabinet 102. It should be appreciated that doors having a different style, position, or configuration are possible within the scope of the present subject matter.

Figure 2:
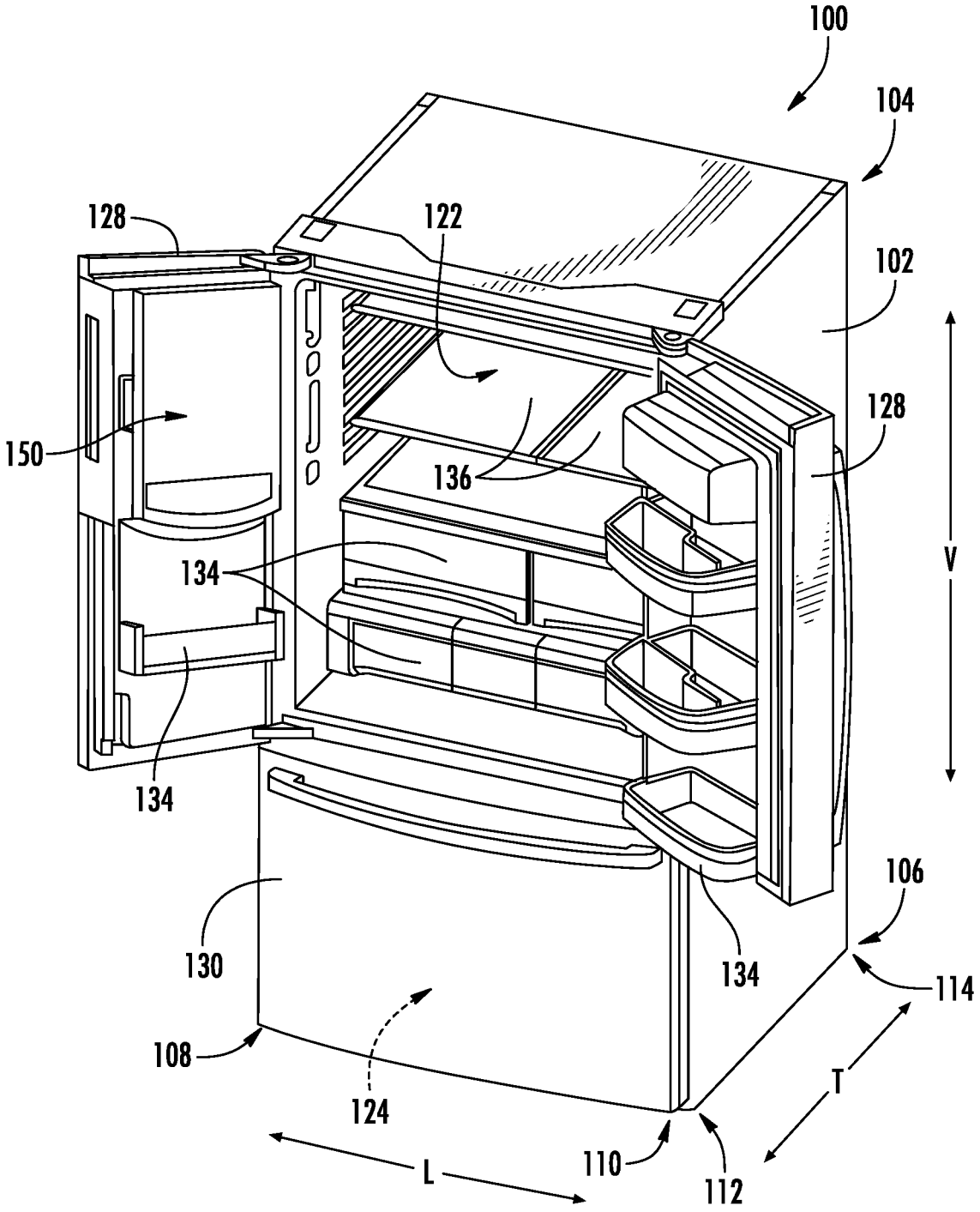
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring again to FIG. 1, a dispensing assembly 140 will be described according to exemplary embodiments of the present subject matter. Although several different exemplary embodiments of dispensing assembly 140 will be illustrated and described, similar reference numerals may be used to refer to similar components and features. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. By contrast, refrigerator door 128 may define an icebox compartment 150 (FIG. 2) housing an icemaker and an ice storage bin (not shown) that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate refrigerator appliance 100, dispensing assembly 140 and other components of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring again briefly to FIG. 1, according to an exemplary embodiment, cabinet 102 also defines a mechanical compartment 170 at or near the bottom 106 of the cabinet 102 for receipt of a hermetically sealed cooling system 172. In general, sealed cooling system 172 is configured for transporting heat from the inside of refrigerator appliance 100 to the outside (e.g., by executing a vapor-compression cycle or another suitable refrigeration cycle). As is generally understood by those of skill in the art, the hermetically sealed system 172 contains a working fluid, e.g., refrigerant, which flows between various heat exchangers of the sealed system 172 where the working fluid changes phases while transferring thermal energy.

In some embodiments, refrigerator appliance 100 also includes one or more sensors that may be used to facilitate improved operation of refrigerator appliance 100, such as described below. For example, in order to obtain temperature measurements within one or more chilled chambers 122, 124 (or regions/zones within chilled chambers 122, 124), refrigerator appliance 100 may include a plurality of temperature sensors (not shown). Controller 156 may be communicatively coupled with the temperature sensors, may receive signals from these temperature sensors that correspond to the temperature of an atmosphere or air within their respective locations, and may implement responsive action, e.g., by directing more or less cooling air toward that region or chamber.

Referring now generally to FIGS. 3 through 11, a bin assembly 200 which may be used with refrigerator appliance 100 will be described according to exemplary embodiments of the present subject matter. In this regard, for example, bin assembly 200 may be mounted below the shelf within a refrigerator appliance, e.g., such as one or more of shelves 136 of refrigerator appliance 100. As explained in more detail below, bin assembly 200 is a relatively low-profile storage bin that occupies space that is otherwise commonly unutilized within a chilled chamber of a refrigerator appliance 100. Although bin assembly 200 is described herein as being mounted to shelf 136 of refrigerator appliance 100, it should be appreciated that aspects of the present subject matter may be used to mount a storage bin under any other suitable shelf or other horizontal structure in any other suitable appliance or other application. The exemplary structure illustrated and described herein is only intended to facilitate discussion of aspects of the present subject matter and is not intended to be limiting in any manner to the scope of the present disclosure.

As illustrated, shelf 136 may be mounted to cabinet 102 of refrigerator appliance 100 using a plurality of mounting brackets 202. More specifically, each shelf 136 may be supported by two mounting brackets 202 that are positioned on opposite lateral sides of shelf 136 and are mounted to a track system 204 defined on a back wall of cabinet 102. In this manner, mounting brackets 202 are adjustable along the vertical direction V, e.g., by engaging a latching mechanism (not shown) of each mounting bracket 202 in different receiving slots of track system 204 as is known in the art. In addition, mounting brackets 202 are commonly cantilevered into fresh food chamber 122 and extend substantially along the transverse direction T toward front opening of cabinet 102. Shelf 136 is then positioned on top of mounting brackets 202 and may be secured or fastened in any suitable manner.

Figure 9:
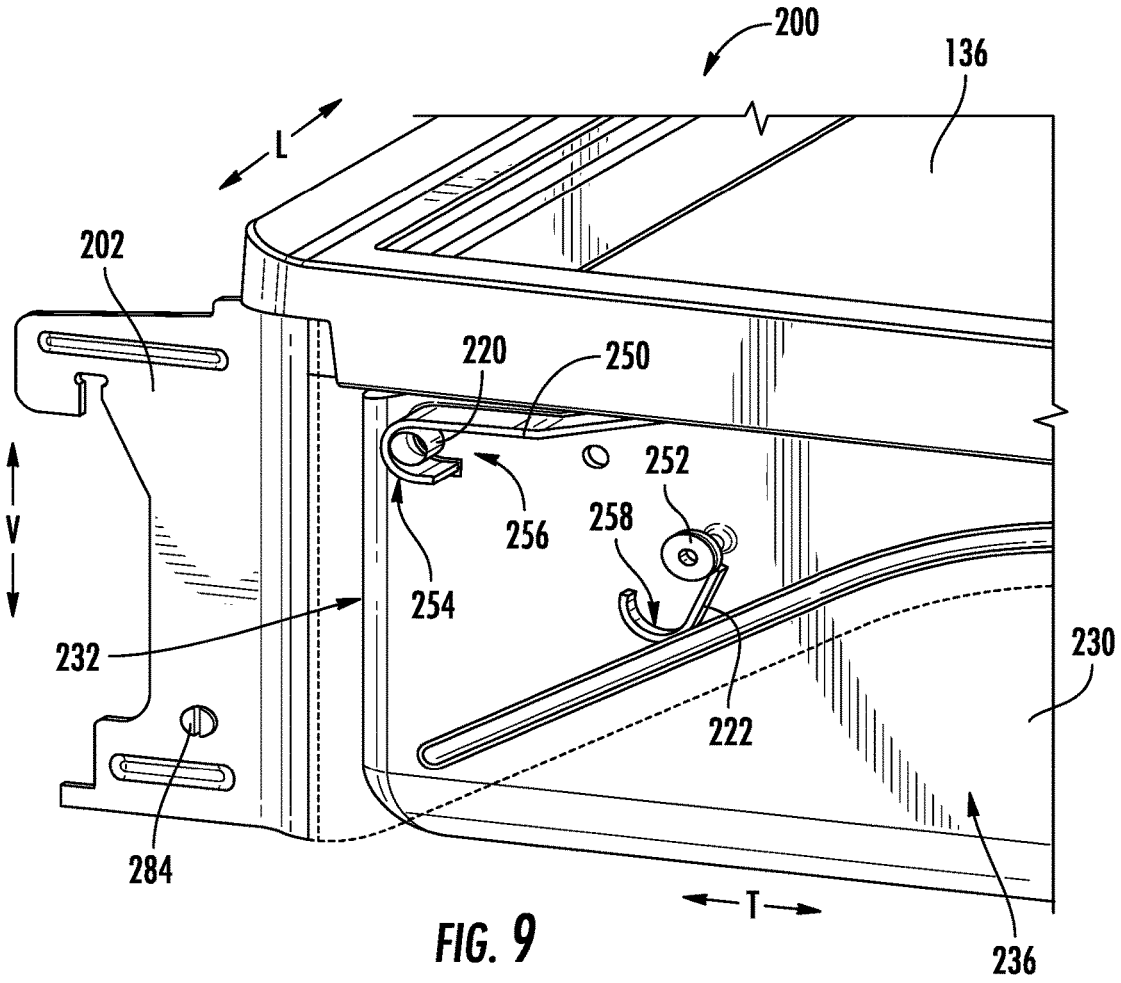
FIG. 9 provides a close-up perspective view of a mounting structure of the exemplary under-shelf storage bin of FIG. 3.
Figure 10:
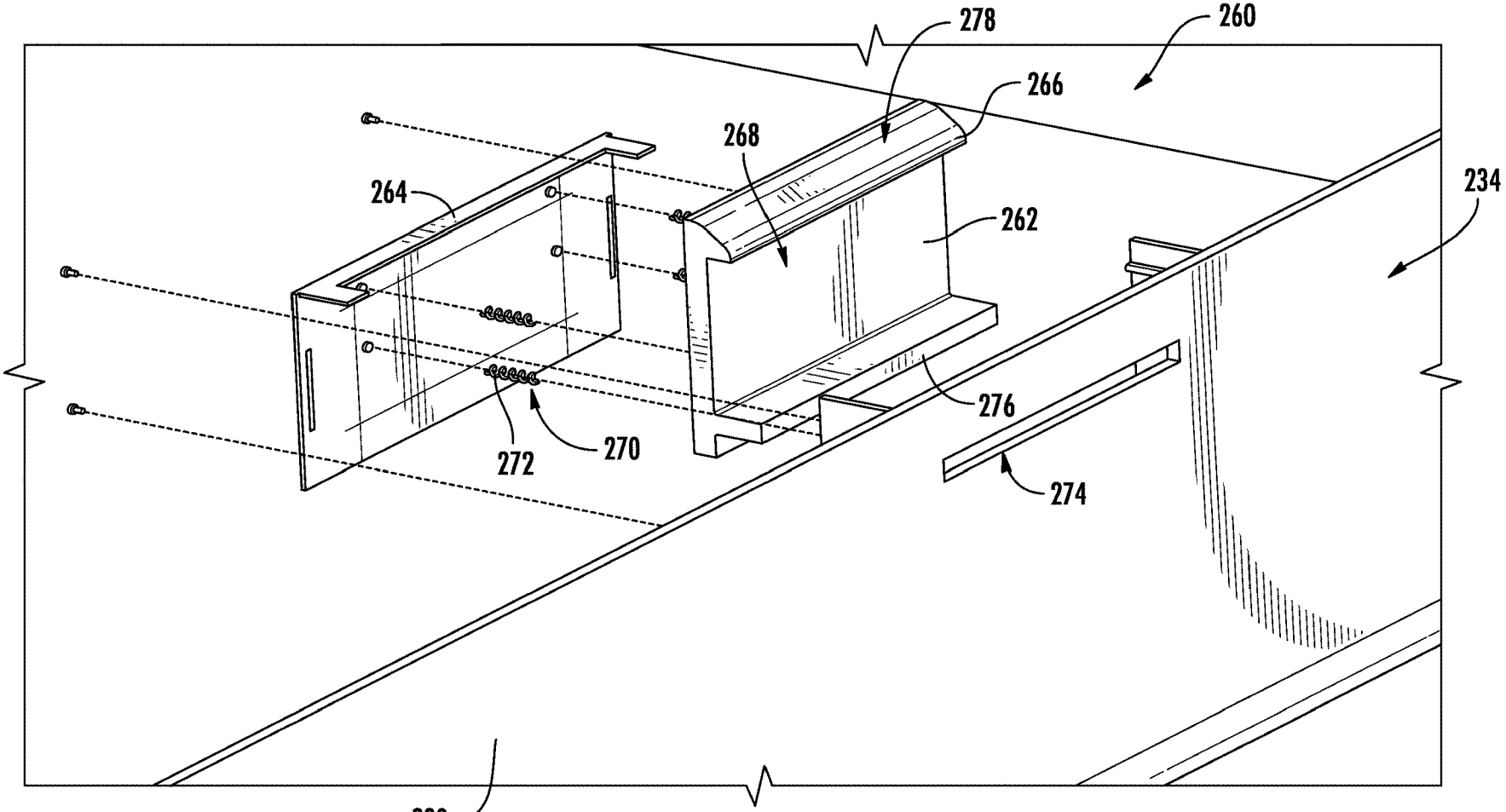
FIG. 10 provides a close-up perspective view of a latch assembly of the exemplary under-shelf storage bin of FIG. 3.
Figure 11:
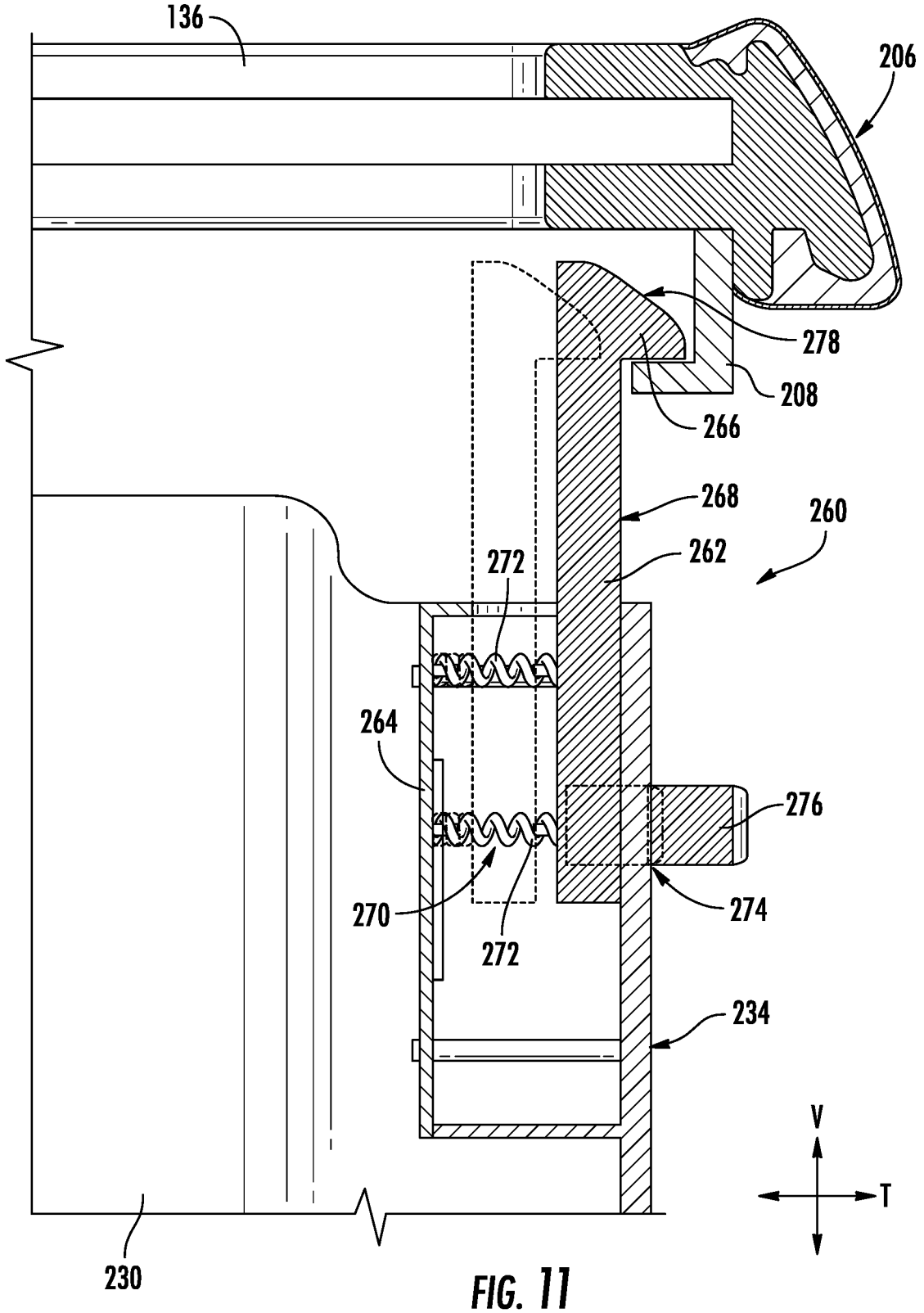
FIG. 11 provides a side schematic view of the exemplary latch assembly of FIG. 10.

According to the exemplary embodiment illustrated in FIGS. 3 through 11, shelf 136 and/or mounting brackets 202 may generally define features that are configured for receiving bin assembly 200. For example, according to the illustrated embodiment, shelf 136 generally extends from track system 204 to a front portion 206 of shelf 136, e.g., at a distal end of shelf 136 nearest to the front opening of refrigerator appliance 100 or proximate refrigerator doors 128. As best shown in FIG. 11, shelf 136 may include a locking flange 208 that extends from front portion 206 downward along the vertical direction V for engaging bin assembly 200 and securing bin assembly 200 in a closed position, as will be described in more detail below.

In addition, each mounting bracket 202 generally defines a mounting pin 220 and a lower guide rib 222, each of which extend from mounting bracket 202 toward bin assembly 200 along the lateral direction L. As will be described in more detail below, mounting bin 220 and lower guide rib 222 are generally intended to support bin assembly 200 and facilitate its movement between an open position and a closed position. It should be appreciated that the structure of these components may vary while remaining within the scope of the present subject matter. For example, although mounting pin 220 is illustrated as a stationary circular pin, it should be appreciated mounting pin 220 may have any other suitable geometry, may be rotatable, etc. Similarly, lower guide rib 222 is generally configured for guiding bin assembly 200 to achieve the desired translation and rotation of bin assembly 200 as it moves between the open position in the closed position. Accordingly, it should be appreciated that the size, shape, and geometry of lower guide rib 222 may vary to achieve different movement profiles of bin assembly 200.

Figure 3:
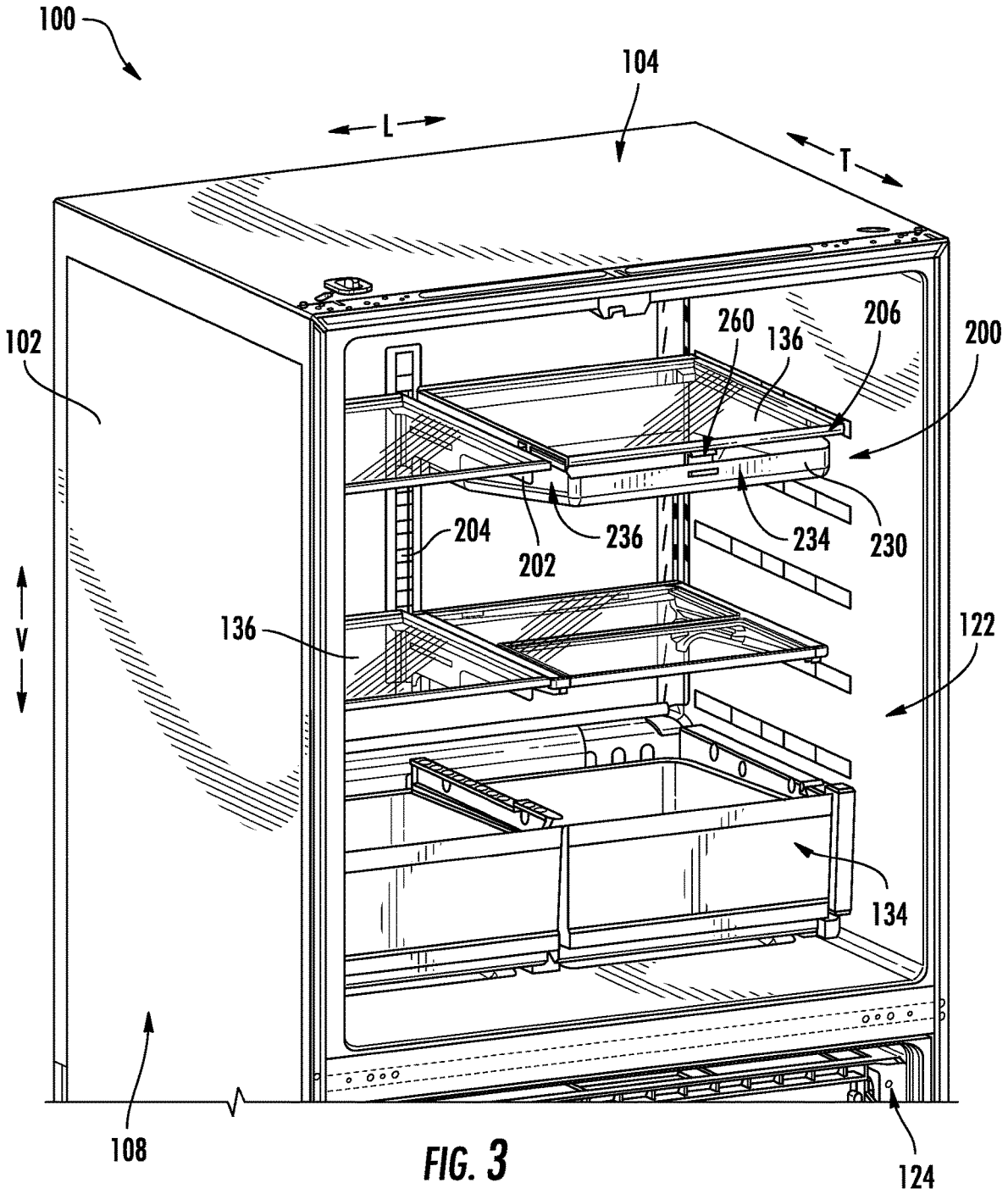
FIG. 3 provides a perspective view of the fresh food chamber of the exemplary refrigerator appliance of FIG. 1, including an under-shelf storage bin in a closed position according to an exemplary embodiment of the present subject matter.
Figure 4:
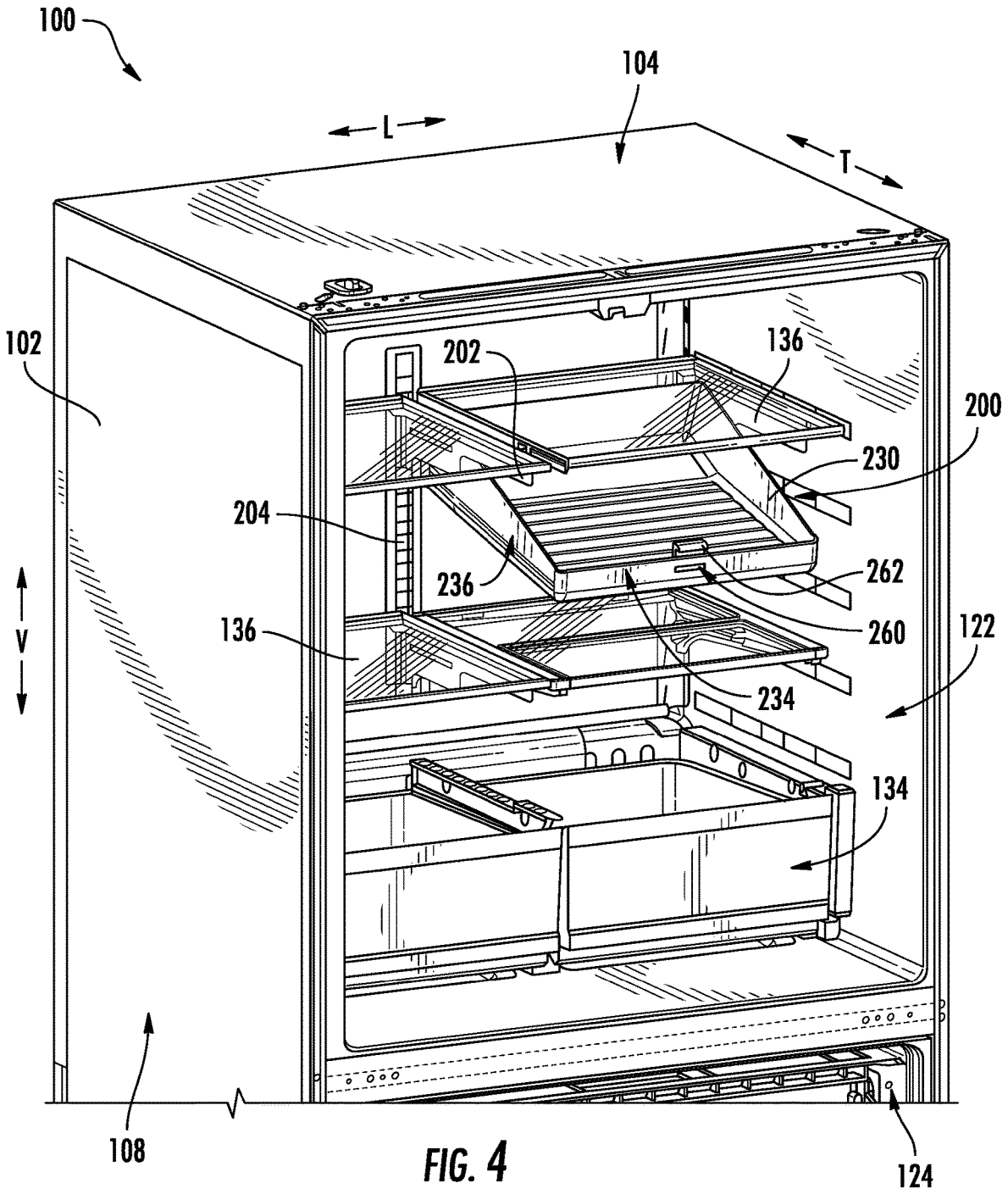
FIG. 4 provides a perspective view of the exemplary under-shelf storage bin of FIG. 3 in an open position according to an exemplary embodiment of the present subject matter.
Figure 5:
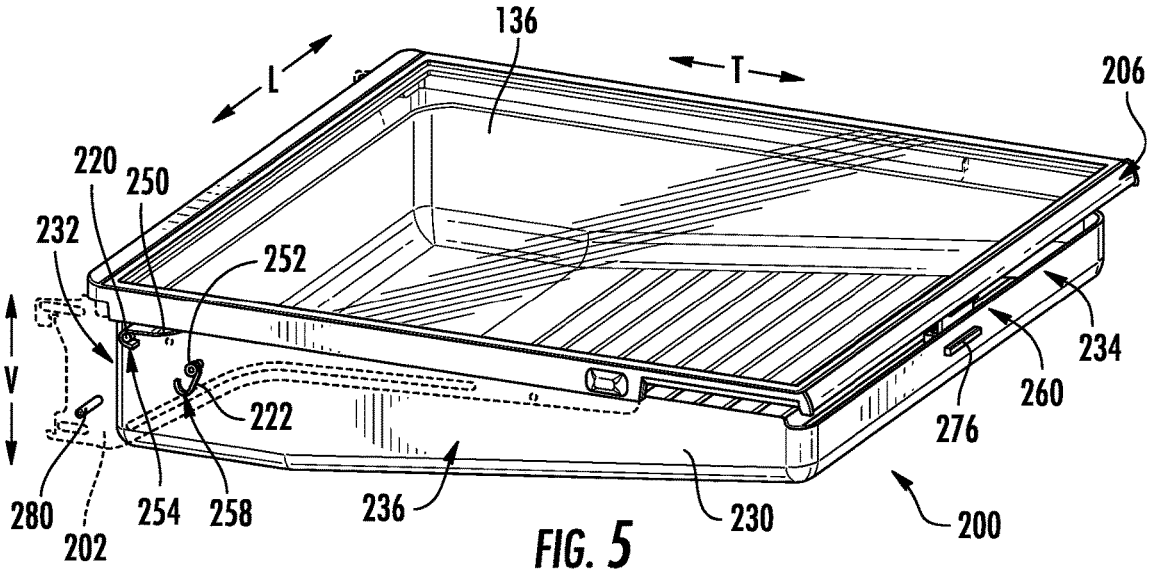
FIG. 5 provides a perspective view of the exemplary under-shelf storage bin of FIG. 3 in the closed position.
Figure 6:
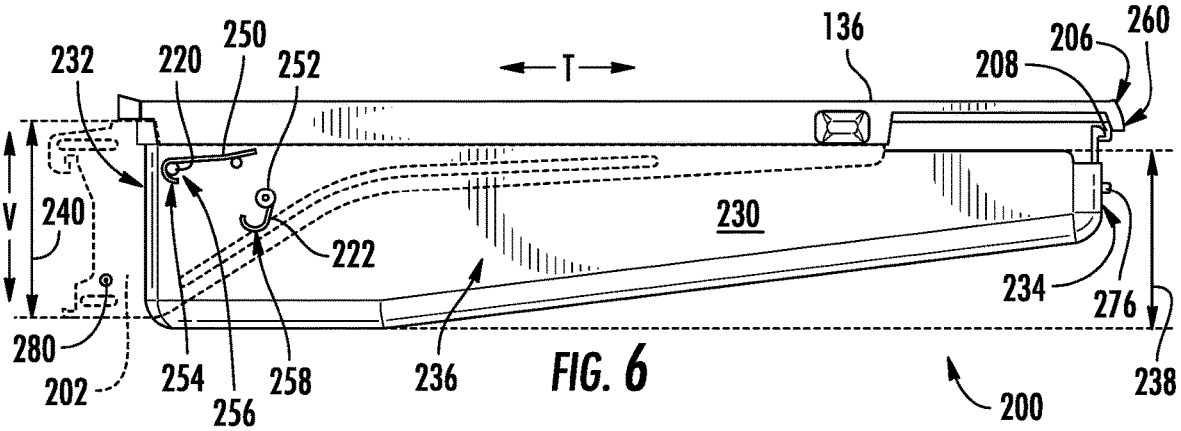
FIG. 6 provides a side view of the exemplary under-shelf storage bin of FIG. 3.
Figure 7:
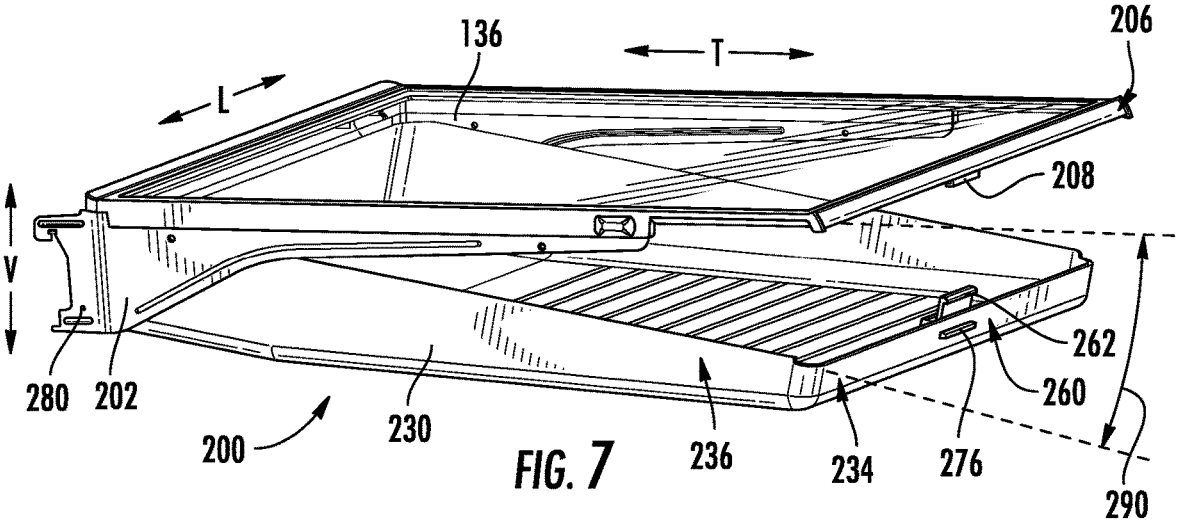
FIG. 7 provides a perspective view of the exemplary under-shelf storage bin of FIG. 3 in the open position.
Figure 8:
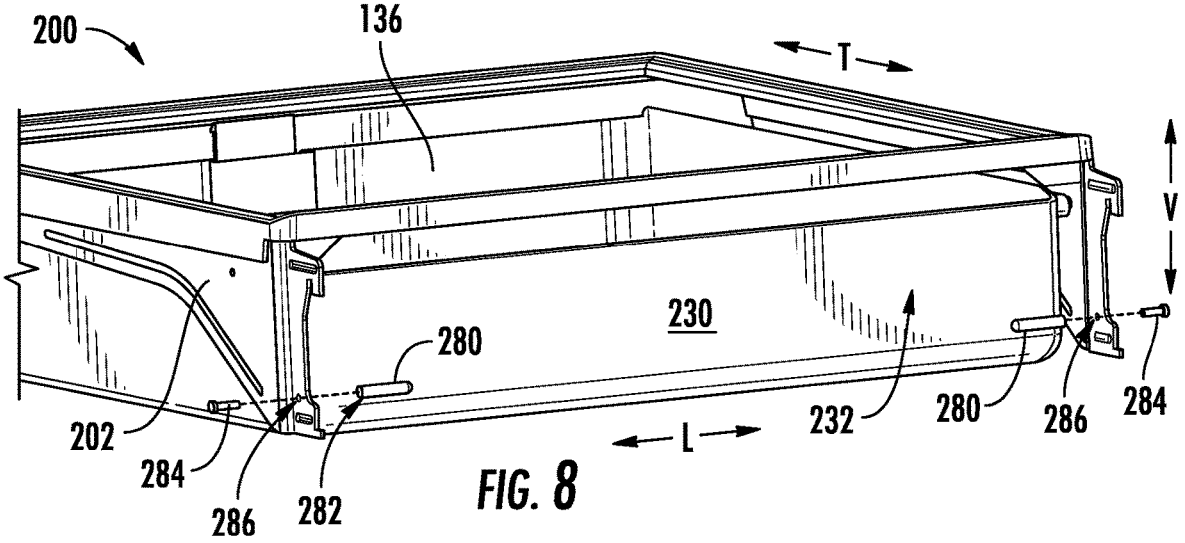
FIG. 8 provides a rear perspective view of the exemplary under-shelf storage bin of FIG. 3.

Referring still generally to FIGS. 3 through 11, bin assembly 200 may generally include a storage bin 230 that is positioned below shelf 136 and is generally movable between an open position (e.g., as shown in FIGS. 4 and 7) and a closed position (e.g., as shown in FIGS. 3, 5, and 6). Storage bin 230 may generally extend from a rear portion 232 to a front portion 234 along the transverse direction T and between sides 236 and the lateral direction L.

As illustrated, storage bin 230 is a relatively low-profile compartment for storing small items below shelf 136 while not interfering with storage space on lower shelves 136 or other lower support structures. Thus, as best shown in FIG. 6, storage bin 230 may generally define a bin height 238 measured along the vertical direction V and mounting bracket 202 may define a bracket height 240 measured along the vertical direction V. According to the illustrated embodiment, the maximum bin height 238 (e.g., proximate rear portion 232 of storage bin 230) may be only slightly larger than bracket height 240. According to still other embodiments, bin height 238 may be less than or equal to bracket height 240. In addition, according to the illustrated embodiment, bin height 238 is generally tapered toward front portion 234. In this regard, bin height 238 is generally reduced toward front portion 234 to provide a less obtrusive view of fresh food chamber 122 and to maximize storage capability of a lower shelf 136. However, it should be appreciated that storage bin 230 may have any suitable size and shape while remaining within scope the present subject matter.

As illustrated in FIGS. 3 through 11, bin assembly 200 may include various complementary geometries for engaging structures on mounting brackets 202 to facilitate the support and movement of storage bin 230 relative to mounting brackets 202. For example, storage bin 230 may generally define an upper locking protrusion 250 and a bin roller 252 that are generally configured for engaging mounting pin 220 and lower guide rib 222 of mounting bracket 202 to support and facilitate movement of storage bin 230 between the open position in the closed position.

Specifically, as best illustrated in FIGS. 5, 6, and 9, upper hooking protrusion 250 is defined by storage bin 230 and generally extends toward mounting bracket 202 along the lateral direction L. Upper hooking protrusion 250 may generally include a curved hook 254 that defines an opening 256 for receiving mounting pin 220 when storage bin 230 is installed. In general, mounting pin 220 is seated within curved hook 254 when storage bin 230 is installed such that storage bin 230 is supported by mounting pin 220 and is rotatable relative to mounting pin 220 as storage bin 230 moves between the open position in the closed position.

In general, bin roller 252 may be mounted to a side 236 of storage bin 230 and may extend toward mounting bracket 202 along the lateral direction L. In general, bin roller 252 is illustrated as a circular roller are mounted to storage bin 230 using a pin. However, it should be appreciated that any other suitable rolling mechanism may be used while remaining within the scope the present subject matter. As shown in the figures, bin roller 252 may generally float above lower guide rib 222 of mounting bracket 202 when storage bin 230 is in the closed position. However, as storage bin 230 is moved toward the open position, bin roller 252 may slidably engage lower guide rib 222 to support storage bin 230 in the open position. More specifically, lower guide rib 222 may define a concave bottom 258 within which mounting pin 220 may be seated to support storage bin 230 in the open position.

As noted above, bin roller 252 may provide a little or no support to storage bin 230 while storage bin 230 is in the closed position. Accordingly, as illustrated generally in FIGS. 3 through 11, storage bin 230 may be supported and locked in the closed position using a latch assembly 260. In general, latch assembly 260 may be mounted on front portion 234 of storage bin 230 and may be configured for engaging locking flange 208 on the shelf 136. Specifically, latch assembly 260 may include a latch member 262 that selectively engages locking flange 208. In this regard, latch assembly 260 may be used to support the front portion 234 of storage bin 230 in the closed position. By contrast, the user may disengage latch assembly 260 to release front portion 234 of storage bin 230 to permit storage bin 230 to pivot toward the open position where bin roller 252 is supported by lower guide rib 222.

As best shown in FIGS. 10 and 11, latch assembly 260 generally includes a base plate 264 that is mounted to front portion 234 of storage bin 230. Latch member 262 is slidably positioned between a front portion 234 of storage bin 230 and base plate 264. In this regard, latch member 262 may translate along the transverse direction between an engaged position (e.g., as shown by solid lines in FIG. 11) and a disengaged position (e.g., as shown by dotted lines in FIG. 11). As shown, latch member 262 may further include a striker 266 that is positioned at a top end of latch member 262 and extends forward along the transverse direction T from a front surface 268 of latch member 262 for engaging locking flange 208.

According to the illustrated embodiment, latch assembly 260 further includes a resilient element 270 that is generally configured for urging latch member 262 toward the front portion 234 of storage bin 230, i.e., toward the latched position. Specifically, according to the illustrated embodiment, resilient element 270 includes a plurality of mechanical springs 272 that are positioned between base plate 264 and latch member 262 to urge latch member 262 away from base plate 264 and toward locking flange 208.

Referring still to FIGS. 10 and 11, front portion 234 of storage bin 230 may define a button aperture 274 through which a user may engage latch member 262 to disengage latch assembly 260. More specifically, according to the exemplary embodiments, latch member 262 may further include a push button 276 that extends from front surface 268 along the transverse direction T and through button aperture 274. In this manner, a user may press push button 276 to deflect mechanical springs 272 and move latch member 262 to an unlatched position where striker 266 is disengaged from locking flange 208. Once latch assembly 260 disengaged, a user may lower storage bin 230 until it is supported by mounting bin roller 252. Striker 266 may define a tapered upper portion 278 that engages locking flange 208 as a user presses upward on storage bin 230 toward the closed position to deflect latch member 262 until it snaps back into the latched position.

Bin assembly 200 may include additional features to prevent storage bin 230 from pivoting too far in the open position. In this regard, for example, bin assembly 200 may further include a stopping pin 280 that extends through mounting bracket 202 along the lateral direction L at a bottom rear storage bin 230. Stopping pin 280 may generally serve to stop storage bin 230 from rotating until it contacts back wall of cabinet 102. According to exemplary embodiments, stopping pin 280 may be mounted by a mechanical fastener. In this regard, as best shown for example in FIG. 8, stopping pin 280 may define a threaded aperture 282 and stopping pin 280 may be mounted when a threaded fastener 284 is passed through an aperture 286 in mounting bracket 202 and is received within threaded aperture 284. According to exemplary embodiments, a rear portion 232 of storage bin 230 may be seated against stopping pin 280 when storage bin 230 is in the open position, e.g., while simultaneously being supported by bin roller 252.

Notably, the position and profile of bin roller 252 and lower guide rib 222 may generally determine the movement of storage bin 230 from the closed position to the open position. In this regard, for example, bin roller 252 and lower guide rib 222 may be formed such that storage bin 230 is rotated through a pivot angle 290 as it moves from the closed position to the open position, as best illustrated in FIG. 7. According to exemplary embodiments, pivot angle 290 is less than about 45° , less than about 30° , less than about 15° , or about 12° . Other pivot angles are possible and within the scope of the present subject matter.

According to exemplary embodiments, storage bin 230 may be removed from mounting brackets 202, e.g., to facilitate cleaning, provide more storage space on a lower shelf 136, etc. Specifically, according to the illustrated embodiment, storage bin 230 may be removed by passing upper locking protrusion 250 back along the transverse direction T, e.g., to pass mounting pin 220 out of curved hook 254. Storage bin 230 may then be moved upward along the vertical direction V and forward along the transverse direction T over mounting pin 220 to remove storage bin 230.

Figure 12:
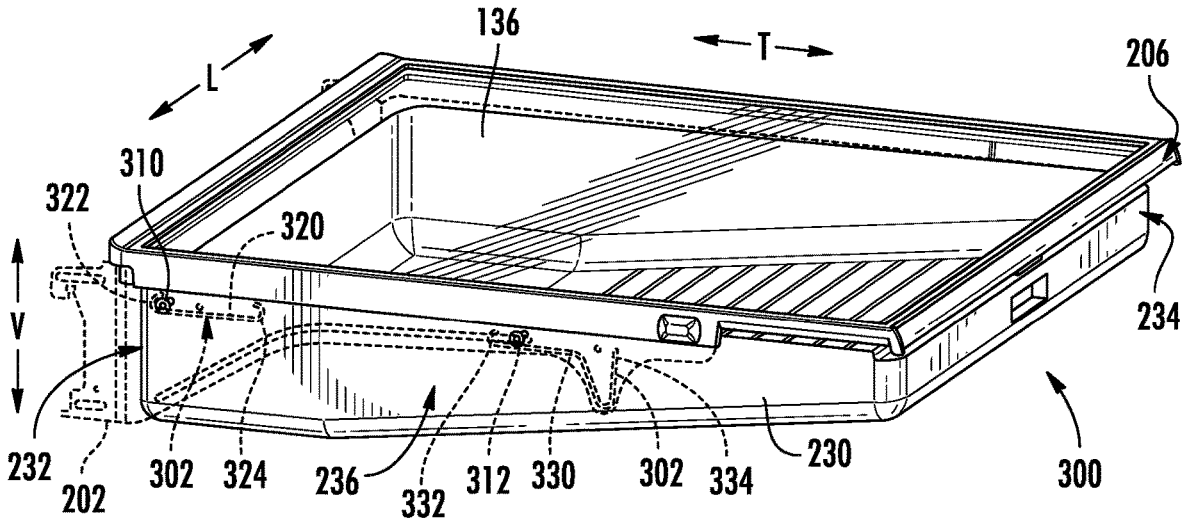
FIG. 12 provides a perspective view of an under-shelf storage bin in a closed position according to another exemplary embodiment of the present subject matter.
Figure 13:
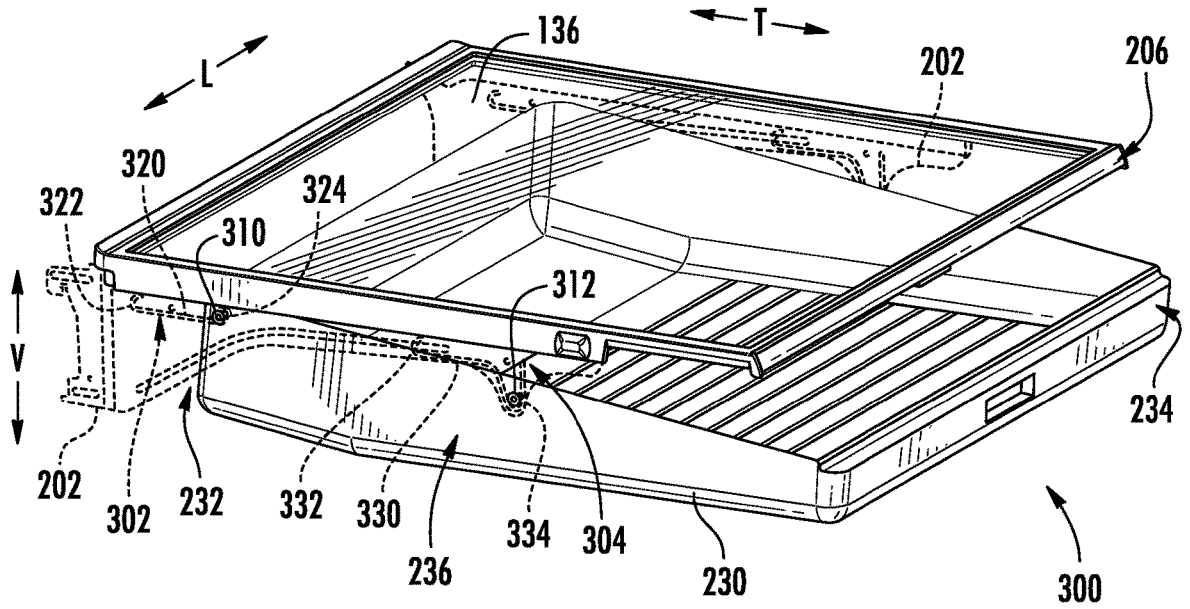
FIG. 13 provides a perspective view of the exemplary under-shelf storage bin of FIG. 12 in the open position.

Referring now briefly to FIGS. 12 and 13, a bin assembly 300 will be described according to an alternative embodiment of the present subject matter. Notably, bin assembly 300 may be similar in many respects to bin assembly 200. Accordingly, a full description of bin assembly 300 will be omitted here for brevity and like reference numerals may be used to refer to the same or similar features among embodiments. In general, bin assembly 300 is similar to bin assembly 200 except that it may not have a latch assembly and may be supported solely by bin rollers and guide ribs, as described in more detail below.

Specifically, according to the illustrated embodiment, mounting bracket 202 may generally define a front guide rib 302 and a rear guide rib 304, each of which extend along the lateral direction from mounting bracket 202 toward storage bin 230. In addition, bin assembly 300 may include a rear roller 310 that is mounted to storage bin 230 and is slidably seated within rear guide rib 304. In this regard, when storage bin 230 is installed, rear roller 310 may be seated within and slide along rear guide rib 304 for supporting rear portion 232 of storage bin 230 as storage bin 230 moves between the open position in the closed position. Similarly, bin assembly 300 may include a front roller 312 that is mounted to storage bin 230 and is slidably seated against front guide rib 302 for supporting front portion 234 of storage bin 230 as storage bin 230 moves between the open position in the closed position.

Specifically, according to the illustrated embodiment, rear guide rib 304 may generally define a horizontal support surface 320, a rear stop 322, and a front stop 324 such that rear roller 310 slides in a horizontal direction as storage bin 230 slides between the open position in the closed position, while rear stop 322 and front stop 324 prevent rear roller 310 from falling off of horizontal support surface 320. Front guide rib 302 may generally define a horizontal support surface 330, a rear stop 332, and a front dip 334 such that front roller 312 slides forward along the transverse direction T and downward along the vertical direction V as storage bin 230 is moved from the closed position to the open position.

Notably, the geometry of front guide rib 302 and rear guide rib 304 along with the position of rear roller 310 and front roller 312 may help dictate the movement profile of storage bin 230 as it moves between the closed position and the open position. For example, the depth of front dip 334 may determine the pivot angle 290 of storage bin 230. In addition, the length of horizontal support surfaces 320, 330 may help determine how far storage bin 230 slides along the transverse direction T. It should be appreciated that the geometries provided herein are only exemplary and are not intended to limit the present subject matter in any manner.

Notably, similar to the configuration of bin assembly 200, bin assembly 300 may permit removal of storage bin 230. In this regard, for example, both front guide rib 302 and rear guide rib 304 define upper openings through which rear roller 310 and front roller 312 may be lifted. Thus, to remove storage bin 230, a user may simply lift storage bin 230 upward along the vertical direction V to disengage front roller 312 from front guide rib 302 and rear roller 310 from rear guide rib 304. In this position, a user may simply pull storage bin 230 forward along the transverse direction T to remove storage bin 230. This procedure may be reversed to install storage bin 230.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:
- a cabinet defining a chilled chamber;
- a door being rotatably hinged to the cabinet to provide selective access to the chilled chamber;
- a shelf positioned within the chilled chamber, the shelf defining a locking flange at a front portion of the shelf;
- a mounting bracket supporting the shelf within the chilled chamber, the mounting bracket defining a mounting pin and a lower guide rib; and
- a bin assembly comprising:
  - a storage bin positioned below the shelf and being movable between an open position and a closed position;
  - an upper hooking protrusion extending from the storage bin toward the mounting bracket, the upper hooking protrusion being supported by the mounting pin and being rotatable relative to the mounting pin as the storage bin is moved between the open position and the closed position;
  - a bin roller mounted to the storage bin and slidably engaging the lower guide rib as the storage bin is moved toward the open position, the bin roller being seated in a concave bottom of the lower guide rib to support the storage bin in the open position; and
  - a latch assembly comprising a latch member that selectively engages the locking flange of the shelf to support a front portion of the storage bin in the closed position.

2. The refrigerator appliance of claim 1, wherein the bin assembly further comprises:

a stopping pin extending through the mounting bracket along the lateral direction at a bottom rear of the storage bin in the closed position.

3. The refrigerator appliance of claim 2, wherein the stopping pin defines a threaded aperture, the stopping pin being mounted by a threaded fastener that is passed through an aperture in the mounting bracket and is received in the threaded aperture.

4. The refrigerator appliance of claim 2, wherein a back wall of the storage bin is seated against the stopping pin when the storage bin is in the open position.

5. The refrigerator appliance of claim 1, wherein the storage bin is rotated through a pivot angle between the open position and the closed position, the pivot angle being less than 30 degrees.

6. The refrigerator appliance of claim 5, wherein the pivot angle is less than 15 degrees.

7. The refrigerator appliance of claim 1, wherein the latch assembly comprises:

a base plate mounted to a front portion of the storage bin;

a latch member slidably positioned between the front portion of the storage bin and the base plate, the latch member defining a striker that extends from a front surface of the latch member for engaging the locking flange; and a resilient element for urging the latch member toward the front portion.

8. The refrigerator appliance of claim 7, wherein the front portion of the storage bin defines a button aperture, and wherein the latch assembly further comprises:

a push button extending from the front surface of the latch member through the button aperture such that pressing the push button deflects the resilient element and moves the latch member to an unlatched position.

9. The refrigerator appliance of claim 7, wherein the resilient element comprises one or more mechanical springs positioned between the base plate and the latch member.

10. The refrigerator appliance of claim 1, wherein the storage bin is removable from the mounting bracket by passing the upper hooking protrusion back along the transverse direction, up along the vertical direction, and forward along the transverse direction over the mounting pin.

11. The refrigerator appliance of claim 1, wherein the mounting bracket is a first mounting bracket, the refrigerator appliance further comprising a second mounting bracket, wherein the first mounting bracket and the second mounting bracket are positioned on opposite lateral sides of the storage bin for supporting the storage bin.

12. The refrigerator appliance of claim 1, wherein the mounting bracket defines a bracket height measured along the vertical direction and the storage bin defines a bin height measured along the vertical direction, and wherein the bin height is less than or equal to the bracket height.

* * * * *